US007716753B2

(12) United States Patent
Franko

(10) Patent No.: US 7,716,753 B2
(45) Date of Patent: May 18, 2010

(54) UNDERGARMENT FOR WOMEN

(76) Inventor: David J. Franko, 4606 Deer Shadow Trail, Sioux City, IA (US) 51106

( * ) Notice: Subject to any disclaimer, the term of this patent is extended or adjusted under 35 U.S.C. 154(b) by 0 days.

(21) Appl. No.: 12/002,140

(22) Filed: Dec. 14, 2007

(65) Prior Publication Data

US 2008/0276353 A1 Nov. 13, 2008

Related U.S. Application Data

(60) Provisional application No. 60/875,233, filed on Dec. 15, 2006.

(51) Int. Cl.
*A41B 9/04* (2006.01)
*A41B 9/00* (2006.01)

(52) U.S. Cl. ..... 2/406; 2/400

(58) Field of Classification Search ..... 2/400, 2/403, 406, 408; 602/67–72
See application file for complete search history.

(56) References Cited

U.S. PATENT DOCUMENTS 1,742,399 A * 1/1930 Klein ..... 602/70
1,920,648 A * 8/1933 Lane ..... 602/70
5,243,974 A * 9/1993 Allen ..... 607/108
6,058,514 A * 5/2000 Hart ..... 2/406
6,334,223 B1 * 1/2002 Pieri ..... 2/455
6,817,038 B2 * 11/2004 Blanco ..... 2/406

* cited by examiner

*Primary Examiner*—Gloria Hale
(74) *Attorney, Agent, or Firm*—Stinson Morrison Hecker LLP

(57) ABSTRACT

An improved women's undergarment includes a flexible, generally triangular front panel having a bottom corner and top left and top right corners and a rear waistband extending between and connecting the top left and top right corners of the front panel extending partially circumferentially rearwards therefrom. Finally, a pair of lower loop straps is included, one extending between and connecting the top left corner and bottom corner of the front panel and one extending between and connecting the top right corner and bottom corner of the front panel such that when the undergarment is being worn, the front panel being adapted to cover the female genitalia of a person wearing the undergarment with the rear waistband extending around the rear of the waist of a person wearing the undergarment and the left and right lower straps extending around and underneath the buttocks of a person.

7 Claims, 3 Drawing Sheets

UNDERGARMENT FOR WOMEN

CROSS-REFERENCE TO RELATED PATENTS

This application is based on and claims priority to U.S. Provisional Application Ser. No. 60/875,233, filed on Dec. 15, 2006, which is incorporated herein by reference in its entirety.

BACKGROUND OF THE INVENTION

1. Technical Field

The present invention relates generally to women's undergarments and, more particularly, to an improved women's undergarment which includes a flexible, generally triangular front panel having a bottom corner and top left and top right corners, a rear waistband extending between and connecting the top left and top right corners of the front panel extending partially circumferentially rearwards therefrom, and a pair of lower loop straps, one extending between and connecting the top left corner and bottom corner of the front panel and one extending between and connecting the top right corner and bottom corner of the front panel such that when the undergarment is being worn, the front panel covers the female genitalia with the rear waistband extending around the rear of the waist of the person wearing the undergarment and the left and right lower straps extending around and underneath the buttocks of the person thereby providing a comfortable and stylish improved women's undergarment.

2. Description of the Prior Art

There are many different types of women's undergarments which are currently available, with various styles of underwear being designed for particular purposes. Some of the many different types of women's underwear include styles such as boy shorts, bloomers, thongs, "granny panties," and many other styles of panties. Of these, one of the most popular styles is the thong or "G"-string style of underwear which generally includes a generally triangular front panel, a waistband extending around the back of the undergarment, and a center string which extends from the bottom corner of the front panel to the center rear of the waistband. While thongs are generally useful when worn with certain types of outfits, including outfits with which it is important to not show a "panty line," one of the significant problems with thongs is that they can be uncomfortable to wear due to their tendency to "ride up" into the area between the buttocks. There is therefore a need for an improved women's undergarment which will not "ride up" and which is more comfortable for a woman to wear, yet also will not detract from the appearance of the outfits being worn by the woman due to unsightly panty lines or the like.

Therefore, an object of the present invention is to provide an improved women's undergarment.

Another object of the present invention is to provide an improved women's undergarment which includes a generally triangular front panel, a rear waistband and two lower loop straps which go around the legs of the wearer from the bottom of the front panel to the top corner thereof to provide a comfortable yet secure fit.

Another object of the present invention is to provide an improved women's undergarment which can be worn with many different types of outfits while maintaining a preferred lack of panty lines or the such.

Another object of the present invention is to provide an improved women's undergarment in which the front panel completely covers the female genitalia when on the wearer.

Finally, an object of the present invention is to provide an improved women's undergarment which is relatively simple and durable in construction and is safe, efficient, comfortable and effective in use.

SUMMARY OF THE INVENTION

The present invention provides An improved undergarment for women including a flexible, generally triangular front panel having a bottom corner and top left and top right corners and a rear waistband extending between and connecting the top left and top right corners of the front panel extending partially circumferentially rearwards therefrom. A pair of lower loop straps are also included, one extending between and connecting the top left corner and bottom corner of the front panel and one extending between and connecting the top right corner and bottom corner of the front panel such that when the undergarment is being worn, the front panel is adapted to cover the female genitalia of a person wearing the undergarment with the rear waistband extending around the rear of the waist of a person wearing the undergarment and the left and right lower straps extending around and underneath the buttocks of a person.

The present invention thus provides numerous advantages over the prior art. For example, because the lower loop straps of the present invention fit and conform to the lower buttock curve, they are extremely comfortable to wear. Furthermore, because the central string or strap of a thong is eliminated, which is required for proper use of thongs, results in greatly increased comfort for the person wearing the undergarment of the present invention. Finally, the present invention is designed to be unobtrusive when worn, and thus may be worn with many different outfits without sacrificing comfort. Therefore these features render the present invention a substantial improvement over the prior art.

DESCRIPTION OF THE PREFERRED EMBODIMENT

Figure 1:
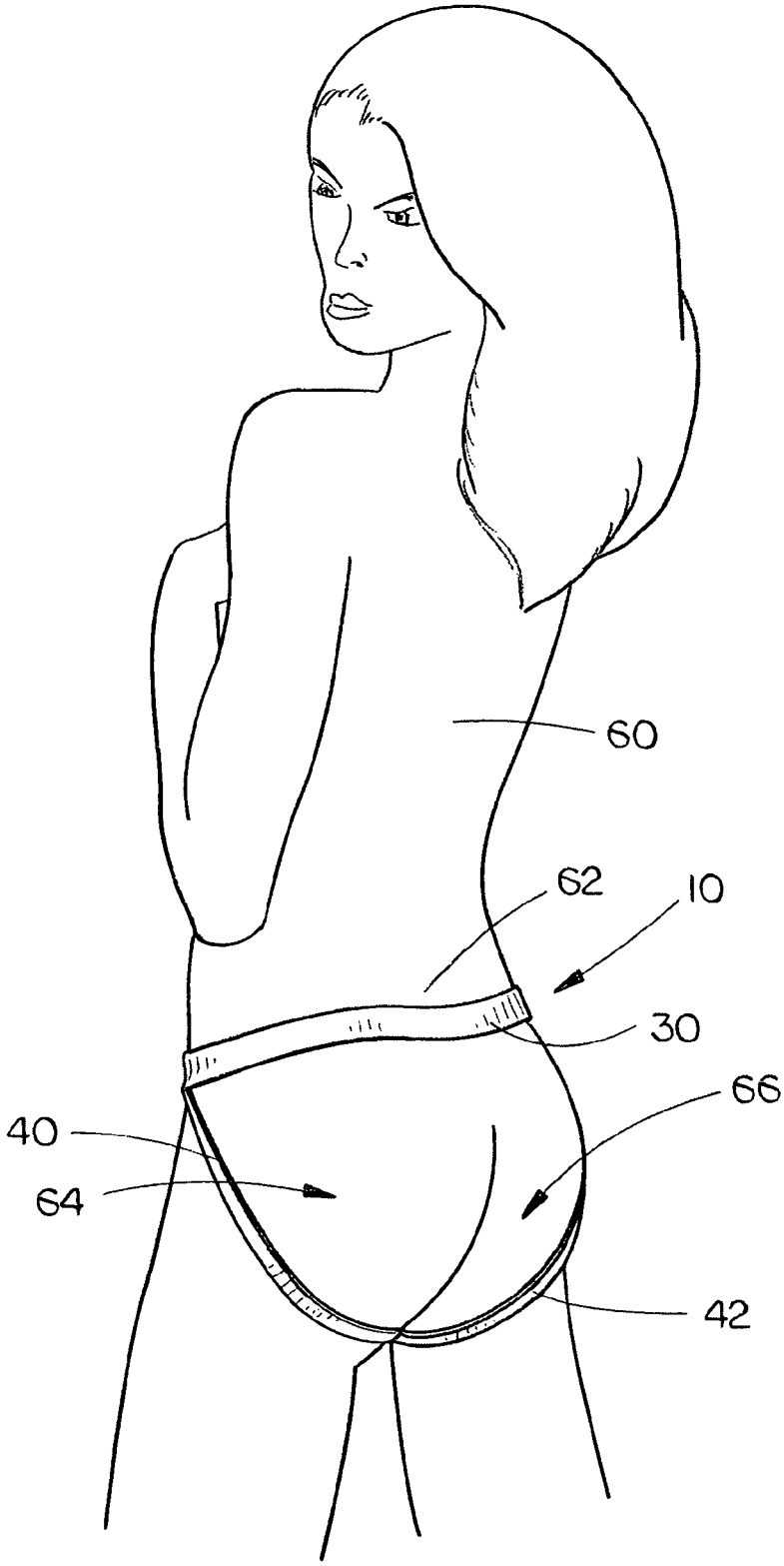
FIG. 1 is a perspective view of the improved women's undergarment of the present invention being worn.
Figure 2:
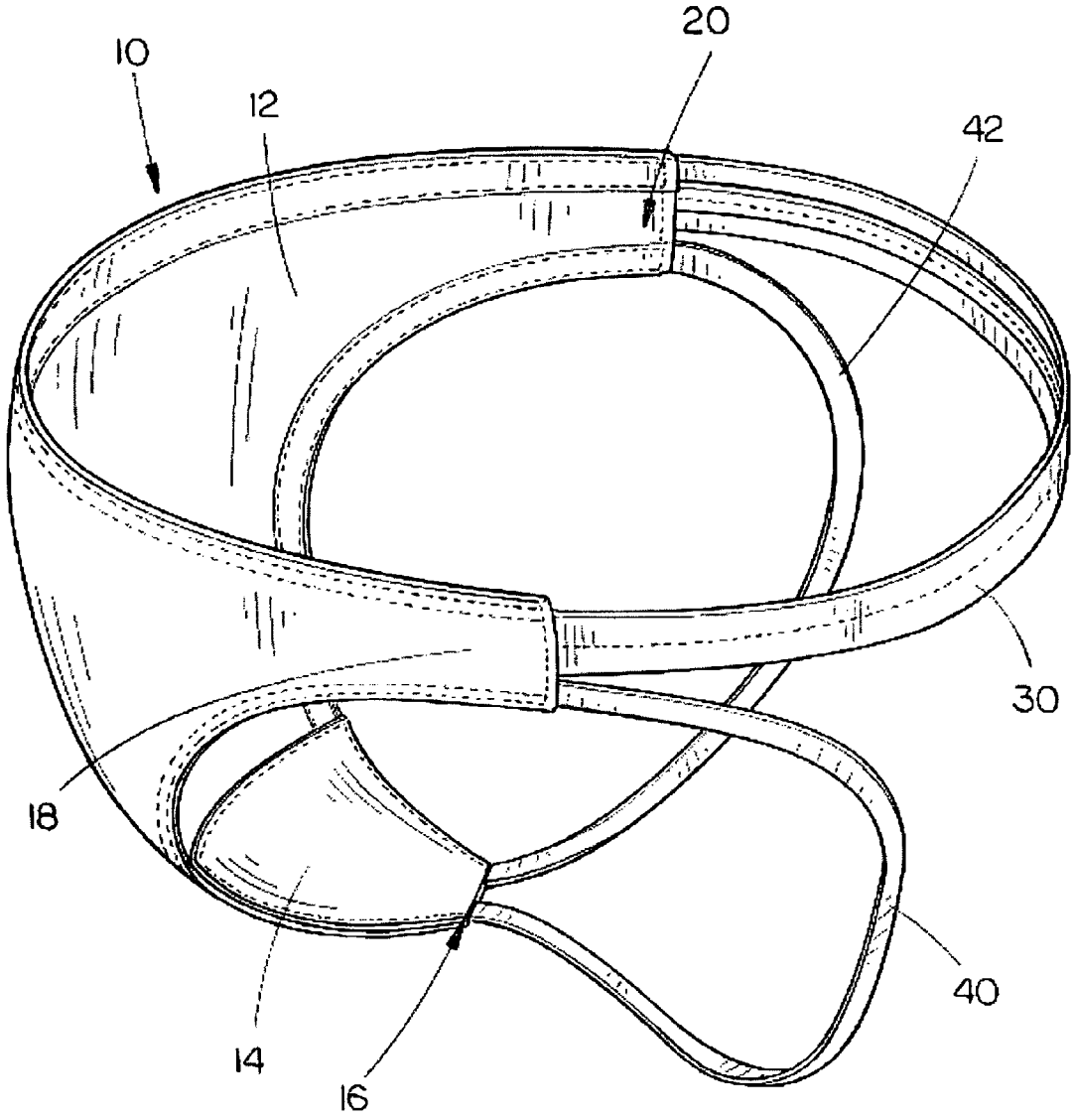
FIG. 2 is a perspective view of the improved women's undergarment of the present invention.
Figure 3:
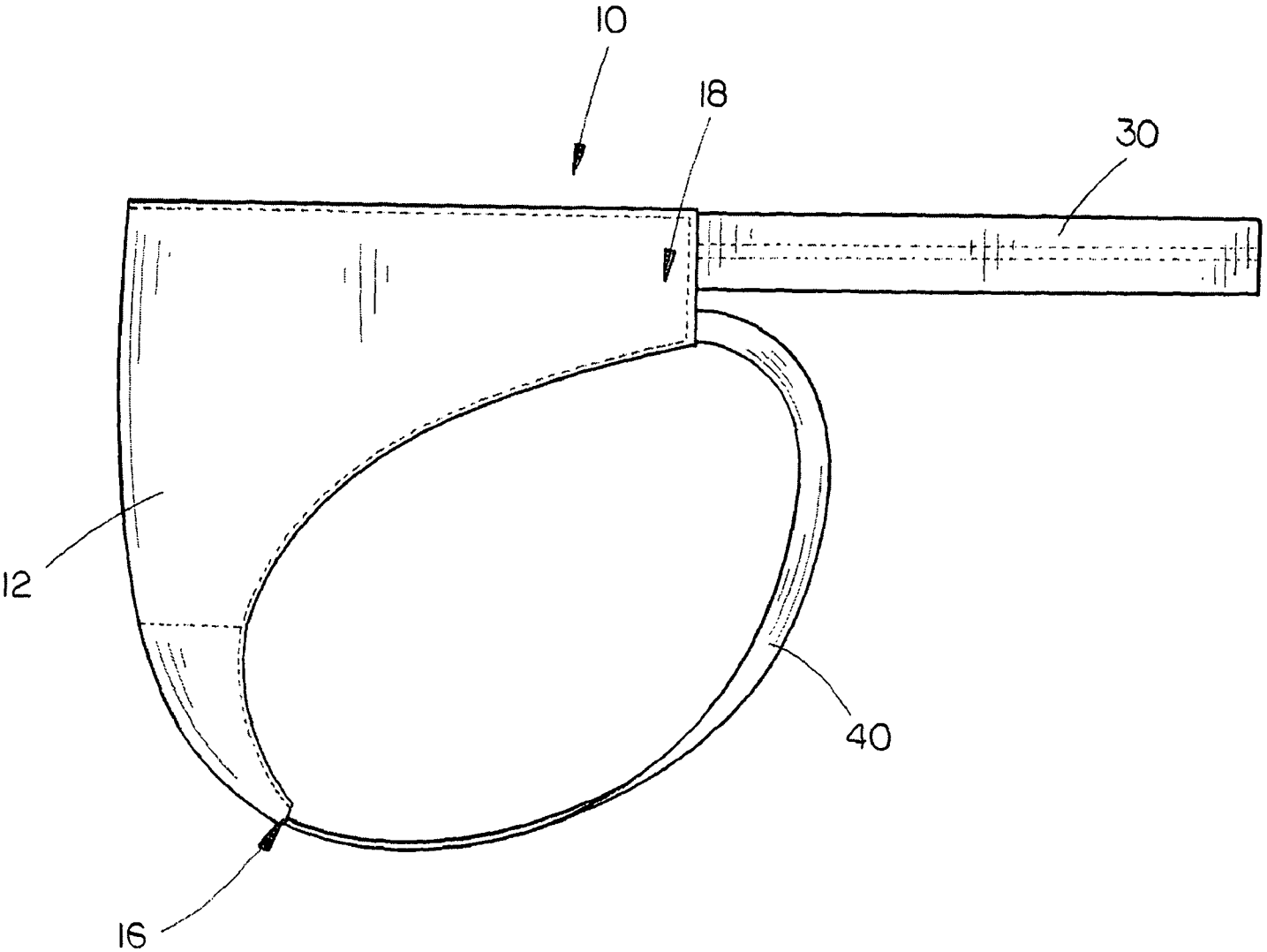
FIG. 3 is a side elevational view of the present invention.

The improved women's undergarment 10 of the present invention is shown best in FIGS. 1-3 as including a front panel 12 which is preferably generally triangular in shape and would be constructed of a soft and pliable fabric material such as cotton, silk, or another such comfortable yet durable material. The front panel 12 may also include an inner panel 14 mounted on the inside of front panel 12, the inner panel 14 being constructed of a soft cotton or other such fabric material, the inner panel 14 being positioned generally adjacent the female genitalia, specifically the vagina, when the improved women's undergarment 10 of the present invention is being worn. The front panel 12 would include a bottom corner 16, top left corner 18, and top right corner 20, and would preferably have variable dimensions which would generally be determined by the sizes and preferences of the persons wearing the undergarment, based on comfort and appearance considerations.

Connected to and extending between the top left corner 18 and top right corner 20 of front panel 12 is a rear waistband 30 which, in the preferred embodiment, would be a flexible elastic waistband constructed of a fabric material which also includes an elastic material therein. In the preferred embodiment, the rear waistband 30 would have a length which would be determined by the size of the waist of the wearer of the present invention, although it is expected that the length of rear waistband 30 will be approximately ten to thirty inches in length. The rear waistband 30 may also include decorative touches such as lace or specific patterns or designs printed thereon, as per the various types of underwear currently available on the market, including thong underwear.

Extending between and connecting the top left corner 18 and bottom corner 16 of front panel 12 is a left lower strap 40, and likewise, extending between and connecting the top right corner 20 and bottom corner 16 of front panel 12 is a right lower strap 42, the left and right lower straps 40 and 42 together forming loops through which the legs of the wearer extend, as shown best in FIG. 1. In the preferred embodiment, the left and right lower straps 40 and 42 would each be constructed of a flexible elastic fabric material and would each have lengths of approximately six to thirty inches, again depending on the size of the person wearing the undergarment and the desired comfort level. Also, it should be noted that the left and right lower straps 40 and 42 will generally be much thinner and less obtrusive than the rear waistband 30, although this is not particularly critical to the functionality of the present invention.

When the improved women's undergarment 10 of the present invention is being worn by a person 60, as shown in FIG. 1, the significant advantages of the present invention become apparent. Specifically, when the undergarment 10 is being worn, the rear waistband 30 would extend around the waist 62 of the person 60 with the front panel 12 positioned in front of the person 60 such that the front panel 12 covers the genitalia of the person 60 wearing the undergarment 10. Meanwhile, the left and right lower straps 40 and 42 each extend around and are positioned beneath the respective left and right buttocks 64 and 66 of the person 60, thus securing the bottom corner 16 of front panel 12 underneath the lowest part of the genitalia, thereby snugly and securely covering the genitalia. It should be noted that an important feature of the present invention is that the bottom corner 16 of front panel 12 extends rearwards between the legs of the wearer to a point substantially behind the rearmost portion of the female genitalia to completely cover and protect the genitalia. The positioning of the left and right lower straps 40 and 42 and positioning of rear waistband 30 results in a very comfortable fit of the undergarment 10 of the present invention on the person 60, and the elimination of the central string or strap which is required for proper use of thongs results in greatly increased comfort for the person 60 wearing the undergarment 10 of the present invention. Also, because the left and right lower straps 40 and 42 are quite narrow, it is expected that there will be little if any visible external sign of the presence of the left and right lower straps 40 and 42 when viewed through the outer garment being worn over the undergarment 10 of the present invention. The intended purpose of a thong, namely to eliminate "panty lines," is thus fulfilled by the present invention while simultaneously providing a much more secure and comfortable fit of the undergarment 10 on the person 60. It is therefore clear that the present invention provides a substantial improvement over those types of underwear found in the prior art.

It should be noted that numerous additions, modifications and substitutions may be made to the improved women's undergarment 10 of the present invention which fall within the intended broad scope of the above description. For example, the size, shape and construction materials used in connection with the various elements of the present invention may be modified or changed so long as the intended functional features are neither significantly degraded nor destroyed. Furthermore, it should be noted that the positioning of the inner panel 14 on front panel 12 is an important feature of the present invention in that because of the use of the left and right lower straps 40 and 42 to secure the front panel 12, specifically bottom corner 16 of front panel 12, against and behind the lowermost and rearmost portions of the person's genitalia, the undergarment 10 of the present invention provides additional comfort above and beyond those women's undergarments currently available. Finally, although the front panel 12 has been described as being generally triangular in shape, it should be noted that the precise shape of the front panel 12 is not particularly critical to the present invention so long as the left and right lower straps 40 and 42 and rear waistband 30 extend around the waist 62 and left and right buttocks 64 and 66 in a similar manner to that described previously. This will ensure that the undergarment 10 of the present invention is secured on the person 60 wearing the undergarment 10, although it will be generally preferred that the front panel 12 is generally triangular in shape.

There has therefore been shown and described an improved women's undergarment 10 which accomplishes at least all of its intended objectives.

I claim:

1. An undergarment for women comprising:

a flexible, generally triangular front panel having a bottom corner and top left and top right corners;

a rear waistband extending between and connecting the top left and top right corners of the front panel extending partially circumferentially rearwards therefrom; and a pair of lower loop straps, one extending between and connecting the top left corner and bottom corner of the front panel and one extending between and connecting the top right corner and bottom corner of the front panel such that when the undergarment is being worn, the front panel is adapted to cover the female genitalia of a person wearing the undergarment with the rear waistband extending around the rear of the waist of a person wearing the undergarment and the left and right lower straps extending around and underneath the buttocks of a person.

2. The undergarment for women of claim 1 wherein said bottom corner of said front panel is rearwardly extended such that when worn, said bottom corner extends rearwards to a point substantially behind the rearmost portion of a female's genitalia whereby the genitalia are completely covered and protected.

3. The undergarment for woman of claim 1 wherein said front panel is constructed of one of silk, cotton, nylon and polyester.

4. The undergarment for women of claim 1 wherein said rear waistband and said pair of lower loop straps include elastic material.

5. An undergarment for women comprising:

a flexible, generally triangular front panel having a bottom corner and top left and top right corners;

a rear waistband extending between and connecting the top left and top right corners of the front panel extending partially circumferentially rearwards therefrom;

a pair of lower loop straps, one extending between and connecting the top left corner and bottom corner of the front panel and one extending between and connecting the top right corner and bottom corner of the front panel such that when the undergarment is being worn, the front panel is adapted to cover the female genitalia of a person wearing the undergarment with the rear waistband extending around the rear of the waist of a person wearing the undergarment and the left and right lower straps extending around and underneath the buttocks of a person; and said bottom corner of said front panel is rearwardly extended such that when worn, said bottom corner extends rearwards to a point substantially behind the rearmost portion of a female's genitalia whereby the genitalia are completely covered and protected.

6. The undergarment for women of claim 5 wherein said front panel is constructed of one of silk, cotton, nylon and polyester.

7. The undergarment for women of claim 5 wherein said rear waistband and said pair of lower loop straps include elastic material.

* * * * *